United States Patent [19]

Swick

[11] Patent Number: 4,506,459

[45] Date of Patent: Mar. 26, 1985

[54] FASTENER ASSEMBLY FOR THERMAL INSULATION END PANEL FOR A PAPER MACHINE DRYER CYLINDER

[75] Inventor: Edwin G. Swick, Bartlett, Ill.

[73] Assignee: Illinois Tool Works Inc., Chicago, Ill.

[21] Appl. No.: 553,593

[22] Filed: Nov. 21, 1983

[51] Int. Cl.[3] ..... F26B 13/18

[52] U.S. Cl. ..... 34/110; 34/119; 34/124; 165/89; 24/297; 411/509

[58] Field of Search ..... 34/110, 119, 124, 108; 165/89, 146, 185; 24/629, 297; 411/525, 526, 527, 528, 509

[56] References Cited

U.S. PATENT DOCUMENTS

| | | | |
|---|---|---|---|
| 2,191,780 | 2/1940 | Tinnerman | 24/297 |
| 4,241,518 | 12/1980 | Alexy | 165/89 |
| 4,321,759 | 3/1982 | Gamble | 34/110 |

FOREIGN PATENT DOCUMENTS

| | | | |
|---|---|---|---|
| 1319794 | 1/1963 | France | 24/297 |

*Primary Examiner*—Larry I. Schwartz

*Attorney, Agent, or Firm*—J. P. O'Brien; T. W. Buckman

[57] ABSTRACT

A fastener assembly for use with a high temperature heat transfer roll and is provided for joining a sheet of insulating material to the end of said roll by utilizing a protruding bolt head or the like. The fastener assembly comprises a cup-like body defining a cavity for receiving said bolt head and a quantity of adhesive material therewithin. A plurality of inwardly extending projections in said cup-like body cavity may be used to engage the bolt head substantially in an interference fit during setting of the adhesive material. A plurality of through apertures in the cup-like body permit release of any excess quantity of adhesive material therefrom. A shaft portion is formed integral with and projects axially outwardly from the cup-like body and away from the bolt head and is of sufficient axial extent to project through the sheet of insulating material. An enlarged head is carried on an axially outermost end of the shaft portion. A clamping member includes a first surface defining a complementary fastener aperture for engaging the enlarged head and a second, abutment surface extending radially outwardly of the first surface for overlying and abutting a portion of the sheet of material to thereby secure the sheet of material in juxtaposition to the protruding bolt head.

6 Claims, 9 Drawing Figures

FASTENER ASSEMBLY FOR THERMAL INSULATION END PANEL FOR A PAPER MACHINE DRYER CYLINDER

BACKGROUND OF THE INVENTION

This invention relates generally to a novel two-piece fastener assembly for mounting a sheet of material to a bolt head or the like. In particular, the invention is directed to such a fastener assembly for use in the mounting of thermal insulation material sheets or panels to axial end faces of a large heat transfer roller, such as a dryer cylinder for drying a paper web or the like.

In the area of paper manufacture or web drying, it is conventional to feed a wet paper web or the like over a series of large cylinders which rotate. Suitable means, e.g. high temperature steam, are provided for heating the interior of the dryer cylinder so that its exterior periphery will dry the web during transport. In this process, a large amount of heat loss has been heretofore experienced, especially at the axial ends of the dryer cylinder, by both radiation and convection. Accordingly, attempts have been made to mount thermal insulation material sheets on end panels of the axial ends of the dryer cylinders to thereby greatly reduce such heat loss. It will be appreciated that minimizing such heat loss also reduces the energy required for operating the drying machinery, and this is desirable in view of increasing energy costs.

Generally speaking, such dryer cylinders include at their axial ends a plurality of protruding bolt heads which serve to affix the axial end panels thereof to the generally cylindrical machine body. Hence, there is little, save these generally metallic end panels and protruding bolt heads, upon which to affix the desired insulating material. The prior art has devised various means and apparatus for accomplishing such affixation. For example, one method involves the use of cup-like permanent magnets which are affixed to the face of the thermal insulation panels with the cup cavities thereof opening outwardly of the panel and sized to the approximate diameter of the bolt heads. The magnets are then spaced at similar circumferential positions to the bolt heads, so as to magnetically affix the thermal insulation material end panel thereto. However, the retention force of such magnetic means is relatively small and there is no assurance that during operation, the thermal insulation material end panels will not inadvertently become disengaged, due to vibration or the like.

One mechanical clamping arrangement is illustrated, for example, in U.S. Pat. No. 4,313,267. Therein a relatively complex cylindrical sleeve arrangement is provided with a suitable locking or set screw to be locked onto the protruding bolt heads. Each such sleeve mounts a further axially protruding externally threaded fastener member which may be fed through the insulating material in a suitable fashion to receive a mating fastener externally thereof. Thereupon, suitable cooperating sleeve members, washers, or the like are utilized to secure the insulating material to this latter protruding fastener member. However, this arrangement is relatively cumbersome and expensive requiring a plurality of machined parts, which require some pre-assembly. Thereafter, some degree of skill and several specialized tools are required in effecting assembly thereof with the dryer end walls.

OBJECTS AND SUMMARY OF THE INVENTION

Accordingly, it is a general object of the invention to provide a novel and improved fastener assembly for use in affixing a thermal insulation end panel to a paper machine dryer cylinder.

A more specific object is to provide such a fastener assembly which is capable of relatively simple assembly with protruding bolt heads of the dryer axial end without requiring any tools or special skill on the part of the installer.

A related object is to provide such a fastener assembly which may be simply and inexpensively fabricated, as by molding from a suitable plastic material.

A related object is to provide a fastener assembly in accordance with the foregoing objects which reliably holds the insulation material in the desired position over a long service life, and yet is relatively simple to disassemble, if desired.

Briefly, and in accordance with the foregoing objects, a fastener assembly in accordance with the invention is adapted for joining a sheet of material to a protruding bolt head or the like which defines an axis, said fastener assembly comprising: a cup-like body defining a cavity having internal dimensions complementary with the external dimensions of said bolt head for receiving both said bolt head and a quantity of adhesive material therewithin. A plurality of inwardly extending projections in said cup-like body cavity are provided for engaging the bolt head substantially in an interference fit. A plurality of through apertures in the cup-like body are provided for releasing excess adhesive material therefrom. A shaft member or portion projects axially integrally from the cup-like body and away from the bolt head and is of sufficient axial extent to project through said sheet of material and is provided with fastener head means at an axially outermost end thereof. A clamping member includes a first surface defining a complementary fastener aperture for receiving and engaging said fastener head means and a second abutment surface extending radially outwardly of the first surface for overlying and abutting the portion of said sheet of material to thereby secure said sheet of material to the protruding bolt head.

BRIEF DESCRIPTION OF THE DRAWINGS

The foregoing, as well as other objects, features and advantages of the invention will become more readily apparent upon consideration of the following detailed description of the illustrated embodiment, together with reference to the drawings, wherein.

DETAILED DESCRIPTION OF THE ILLUSTRATED EMBODIMENT

Figure 1:
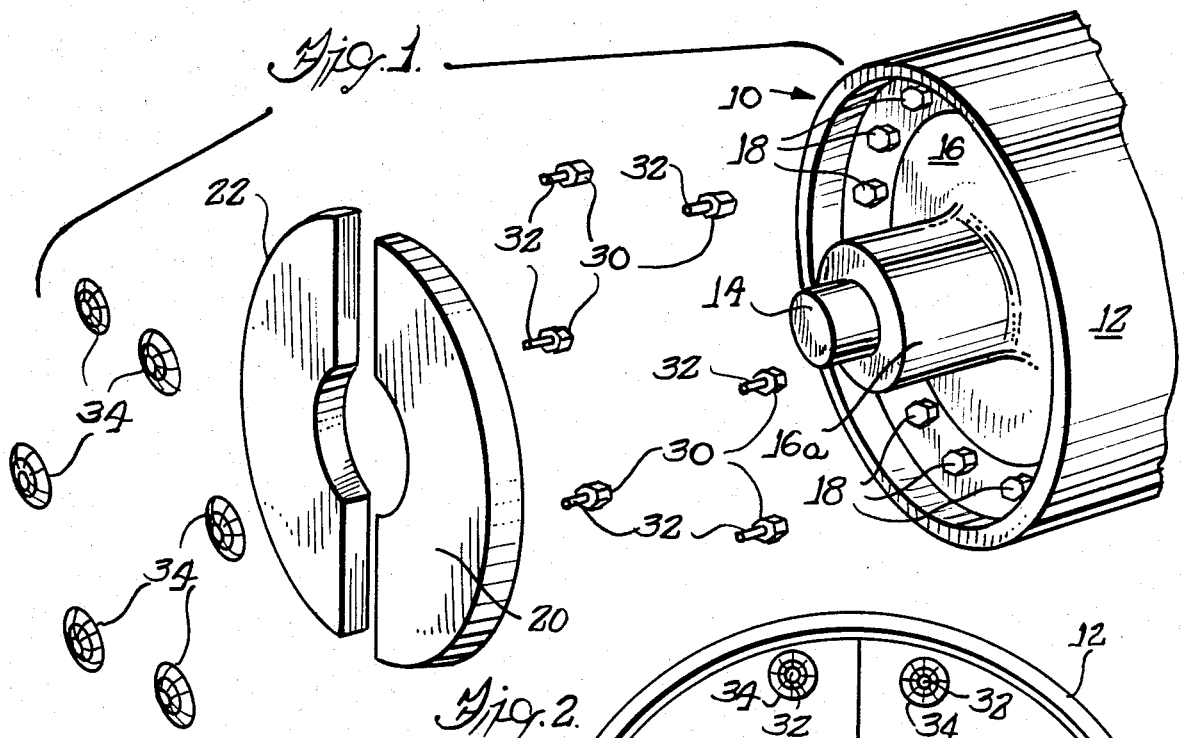
FIG. 1 is a perspective view, somewhat diagrammatic in form, showing an axial end of a dryer cylinder, sheets of insulating material and novel fasteners for fastening this insulating material to the dryer cylinder end in accordance with the invention.
Figure 2:
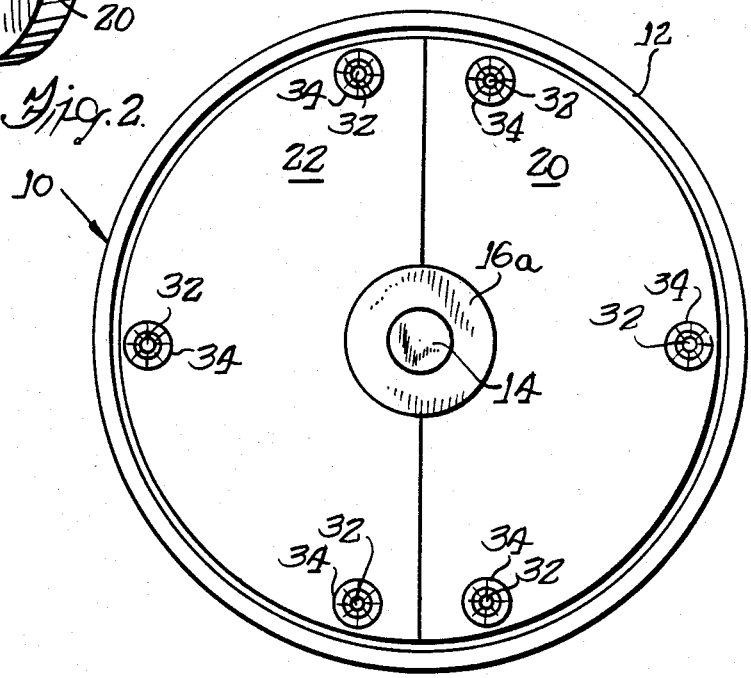
FIG. 2 is an end view of the elements of FIG. 1 in assembled condition.

Referring to the drawings and initially to FIGS. 1 and 2, while the fastener assembly of the invention may find utility in a variety of applications, the description will be facilitated by reference to the particular problem of mounting a sheet of thermal insualtion material to an axial end face of a large heat transfer roller or dryer cylinder. In this regard, a typical dryer cylinder for the drying of paper webs or the like is indicated generally by reference numeral 10. This dryer cylinder 10 includes a metal cylindrical body 12 coupled to a central shaft 14 for rotation about the shaft through end bells 16 (only one of which is shown in reduced form in FIG. 1). These end bells 16 are coupled to the body 12 by means of a plurality of bolts indicated generally in enlarged form at 18 and are generally symmetrically disposed in a circumferentially spaced array on the end bell 16 facing axially outwardly of the dryer cylinder 10.

One or more sheets or panels of thermal insualtion material 20, 22 are provided to overlie and thereby effectively insulate the end bell 16. In accordance with convention, the sheet or sheets of insulating material 20, 22 are generally shaped to define an outer periphery or circumference generally similar to the outer periphery or circumference of end bell 16. However, a central portion or area of the sheet or sheets 20, 22 is left open so as to allow a projecting portion 16*a* of the end bell and the shaft 14 to extend therethrough, once the panels 20, 22 are assembled therewith.

In accordance with the present invention, the panels 20, 22 are advantageously fastened to the protruding bolt heads 18. In this regard, a first fastener member 30 is provided for engaging selected ones of these bolt heads 18. In the illustrated embodiment, these first fastener members 30 are substantially symmetrically and circumferentially spaced about the periphery of end bell 16 for engagement with bolt heads 18. The preferred embodiment (not shown) would desirably have fastener members 30 engaging alternating ones of bolt heads 18, however, other numbers or configurations of such fastener members 30 may be utilized without departing from the invention.

These fastener members 30 also include generally axially outwardly male fastener members or portions 32, which will be more fully described later. These fastener portions 32 are of sufficient axial extent to extend through the thickness of the respective sheets or insulation panels 20,22. Thereupon, suitable complementary clamping or female fastener members 34 are provided for engagement with these fastener end portions 32 of first fastener members 30. As will be appreciated upon reading the following description of the details of the construction and operation of fastener members 30 and 34, the sheets or panels of insulating material 20, 22 may thus be relatively simply coupled to end bell 16 without the need for any tools, or any specialized skill on the part of the installer. Additionally, both fastener members 30, 34 are preferably formed by high temperature resistant, resilient plastic material.

Figure 3:
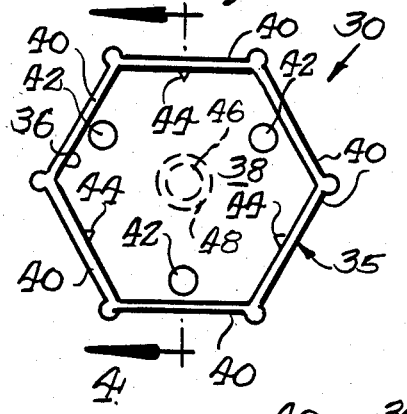
FIG. 3 is a bottom view of one novel fastener member of the fastener assembly of the invention.
Figure 4:
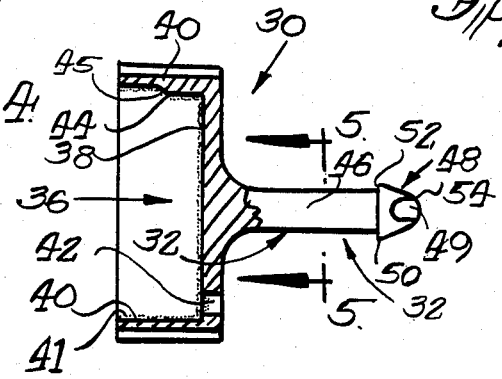
FIG. 4 is a sectional view taken generally along the line 4—4 of FIG. 3.
Figure 5:
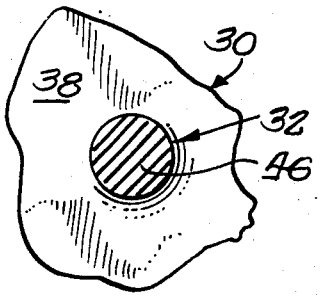
FIG. 5 is an enlarged partial view taken generally along the line 5—5 of FIG. 4.

Referring now to FIGS. 3, 4 and 5, and initially to FIG. 3, the first fastener member 30 will be seen to comprise a cup-like body portion 35 which defines a cavity 36 of a complementary shape for fitting over a respective bolt head 18. In the illustrated embodiment, these bolt heads 18 comprise conventional hex-type bolt heads. Accordingly, the cup-like body 35 is defined by a substantially flat, generally regular hexagonally shaped end wall 38 and six similar side walls 40 which extend from end wall 38 in regular hexagonal array. The body 35 and cavity 36 may of course be configured differently to receive other types of bolt heads, such as square bolt heads, without departing from the invention.

In accordance with a further feature of the invention, the cup-like body cavity 36 (see FIG. 4) is adapted to receive a quantity of adhesive material 41, shown by dots prior to engagement with a bolt head 18, to thereby adhesively affix the fastener member 30 with a bolt head 18. In this regard, a plurality of through apertures 42 in end wall 38 are provided to permit outflow or release from cavity 36 of any excess adhesive material during the assembly thereof with bolt head 18.

In accordance with a further preferred feature of the invention, a plurality of radially inwardly extending projections is provided in the body cavity as indicated by reference numerals 44. These projections are arranged to achieve a snug, or interference fit with a bolt head 18 so as to assure a secure mounting of the cup-like body 35 therewith while the adhesive material is setting up. In the illustrated embodiment, these projections 44 take the form of generally axially extending inwardly projecting rib-like members provided on alternating ones of the sidewalls 40. The illustrated cup 35 is substantially centrally located upon alternate ones of sidewalls 40. It will be appreciated that other configurations and arrangements of these ribs or projections 44 may be utilized without departing from the invention. The ribs 44 also extend only partially up the walls 40 from end wall 38, presenting converging surfaces 45 to facilitate initial engagement of ribs 44 with bolt head 18.

Figure 9:
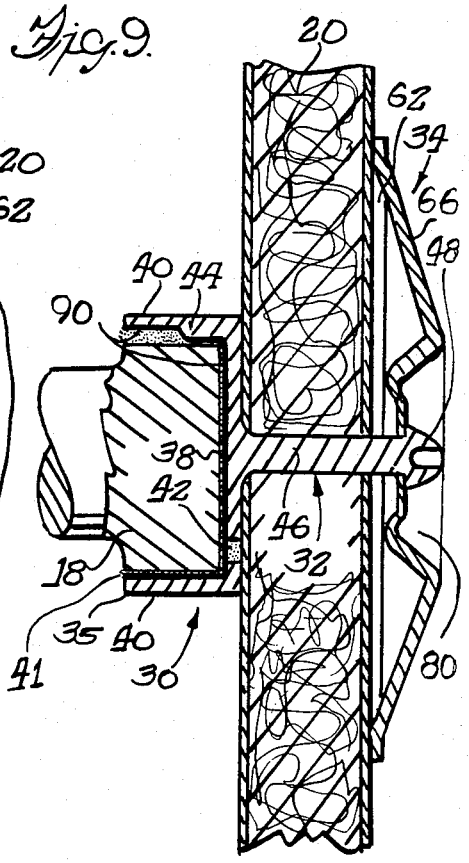
FIG. 9 is a sectional view taken generally on the line 9—9 of FIG. 8.

As best viewed in FIG. 4, the fastener member 30 also includes the previously mentioned male fastener member or portion 32 which projects integrally axially outwardly therefrom and also axially away from the bolt heads 18 when assembled therewith as illustrated for example in FIG. 9. This axially protruding fastener member or portion 32 is substantially centrally or coaxially located with respect to end wall 38 of the body 34. As illustrated, the protruding fastener member includes a substantially cylindrical shaft portion 46 which is of sufficient axial length to extend through the sheets or panels 20, 22. Shaft portion 46 carries at its axially outermost end an enlarged fastener head portion 48.

This fastener head portion 48 defines a base 50 which is generally of greater diameter than that of the shaft 46 whereby a shoulder 52 is defined therebetween.

Preferably, the fastener head 48 converges axially outwardly to define a generally frusto-conical configuration having a leading end portion 54 of generally smaller diameter than both the base portion 52 thereof and the cylindrical shaft portion 46. A central axial recess or cavity 49 is provided in end 54, primarily to aid in the final assembly of the insulation blanket or sheet with the features. A tool such as an awl or the like is pushed through the hole in the blanket and the end of the tool is seated in the recess. The blanket is then slid off the awl directly onto the shaft 46. In accordance with a preferred form of the invention this leading end surface 54 is curvilinear or rounded to enhance initial engagement thereof with a complementary fastener portion formed in clamping or fastener member 34 to be next described.

Figure 6:
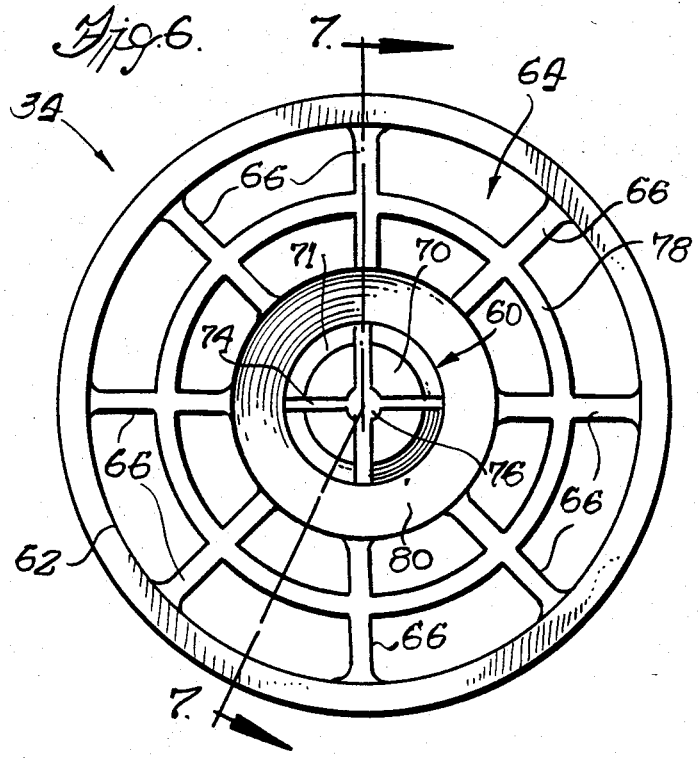
FIG. 6 is a plan view of a second fastener member of the fastener assembly of the invention.
Figure 7:
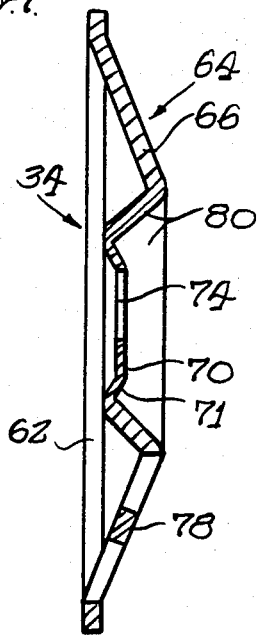
FIG. 7 is a sectional view taken generally along the line 7—7 of FIG. 6.

In this regard, and referring now to FIGS. 6 and 7, the second or complementary fastener member 34 comprises a generally circular body defined by a first or radially inner or central generally circular fastener portion 60 and a radially outer annular abutment portion or ring 62. This latter abutment portion 62 is preferably arranged for flat abutment or engagement with the outer surface of the respective insulating panels or sheets 20, 22. A connecting web portion 64 is defined by a plurality of radially outwardly extending, spaced apart legs 66.

Referring now more particularly to the central fastener portion 60, it will be seen that this portion of the fastener or clamping member 34 is somewhat cupped as indicated at an annular surface 71, to lend additional rigidity thereto. This annular surface 71 integrally joins a generally circular disc-like body 70 which has formed therein a through cruciform aperture 74. Body 70 can also be conical in configuration. In the illustrated embodiment, this aperture 74 further has a somewhat enlarged central circular portion 76 for receiving the leading end surface 54 of the fastener head 48 therethrough. As previously mentioned, the clamping member or fastener 34 is formed of a resilient material such as a plastic, such that the four segments of the disc-like body 70 defined by cruciform aperture 74 resiliently deform somewhat to receive and then snappingly engage with the fastener head 48. In particular, it will be seen that the shoulder 52 defined at the trailing or base end of fastener head 48 thus positively engages the resiliently returned material of disc 70 about cruciform aperture 74, thus encouraging positive coupling therebetween.

Referring to the radially outer abutment portion or ring 62 and connecting web defined by legs 66, the legs 66 extend to substantially equal radial extents outwardly of inner fastener portion 60 to substantially coaxially locate ring 62 with respect thereto. The fingers 66 are further joined by an intermediate annular support member or ring 78 which is integrally formed therewith. This intermediate support ring 78 is preferably coaxial with and equally radially spaced from the central aperture 74 on the one side and from the outer ring 62 on the other. As best viewed in FIG. 7, the web 64 as thus defined by legs 66 and ring 78, comprises a generally frusto-concial surface, that is, a surface which generally converges in a direction from the ring 62 toward the central fastener portion 60.

Additionally, a second or intermediate web of material 80 is interposed intermediate the first web 64 and the central fastener portion 60. This latter web 80 also defines a generally frusto-conical surface which is generally oppositely oriented to the surface defined by the first web 64. In this regard, it will be seen that the web 80 generally diverges in the direction from the central disc-like body 70 toward the junction thereof with first web 64. Accordingly, as best seen in FIG. 7, in cross-section the two webs 64 and 80 and cupped fastener portion 60 define a generally flattened W-shaped configuration.

In view of the resilient nature of the plastic material of which the member 34 is formed, this flattened W-like configuration advantageously defines a resiliency in the body 34 useful in assuring engagement with the sheets or panels 20, 22 of insulating material.

Figure 8:
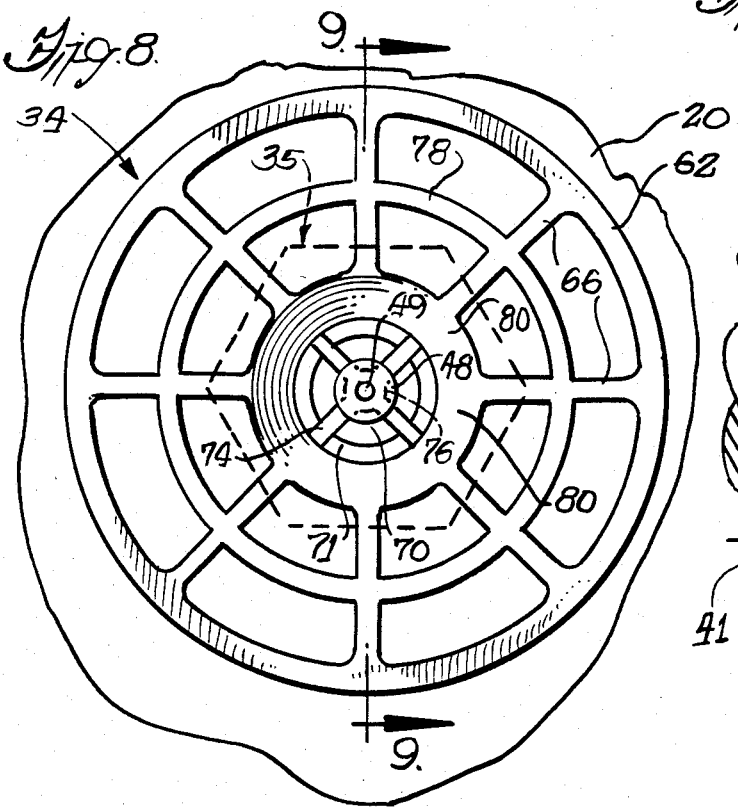
FIG. 8 is a plan view of a portion of a sheet of material assembled with the end of a dryer cylinder utilizing the fastener assembly of the invention.

In this regard, as best viewed in FIGS. 8 and 9, upon assembly with the fastener head portion 48 of fastener member 30, the clamping member 34 may be depressed inwardly generally about central aperture 74 thereof. This results in a resilient deformation of respective webs 80 and 66 causing a positive pressure or engagement between annular ring 62 and a facing surface of the sheet or insulating body 20 engaged therewith.

Hence, the sheets or insulating panels 20, 22 are thereby firmly held in engagement with the facing surface of the fastener member 30 in spaced relation to the end wall of the dryer cylinder 10.

It will be appreciated from the foregoing that the fastener assembly may be readily disassembled if desired by the simple expedient of grasping the clamping member 34, for example about the legs 66 thereof, and pulling axially outwardly. The resiliency of central cruciform opening 74 and surrounding material is such as to permit disengagement thereof from the shoulder 52 defined by fastener head 48. However, it will be further recognized that in normal operation, vibration, thermal effects or the like will not cause disengagement in this fashion. Rather, a more deliberate force applied in the axial direction is necessary to disassemble the foregoing assembly. Such disassembly may be desired from time to time to inspect or repair the dryer assembly 10, or replace the insulating material 20, 22, for example.

While the invention has been illustrated and described herein with reference to a preferred embodiment, the invention is not limited thereto. Those skilled in the art may devise various changes, alternatives and modifications upon reading the foregoing description. The invention includes such changes, alternatives and modifications insofar as they fall within the spirit and scope of the appended claims.

The invention is claimed as follows:

1. A fastener assembly for use with large heat transfer rolls and adapted for joining a sheet of insulating material to a protruding bolt head or the like which defines an axis, said fastener assembly comprising: a cup-like body defining a cavity for accepting said bolt head or the like and a quantity of high temperature adhesive material therewithin; means for retaining said body on said bolt head during setting of said adhesive material; a plurality of through apertures in said cup-like body for releasing any excess quantity of said adhesive material thereform; a cylindrical shaft portion integral with and projecting axially outwardly from said cup-like body and away from said bolt head and of sufficient axial extent to project through said sheet of insulating material; enlarged head portion carried on an axially outermost end of said shaft portion; said enlarged head portion converges axially outwardly and includes a base of diameter greater than the diameter of said cylindrical shaft portion and is coupled therewith to thereby define a substantially annular, radially extending shoulder portion at the junction thereof; and a clamping member including a first surface defining therein a complementary fastener aperture for engaging said head means and a second, abutment surface extending radially outwardly of said first surface for overlying and abutting a portion of said sheet of material to thereby secure said sheet of material in juxtaposition to said protruding bolt head or the like; and said fastener head portion including a rounded leading surface to facilitate initial engagement thereof with said complementary fastener aperture, said leading surface including a depression for accepting a locating tool for locating and assembling said sheet of material on said fastener.

2. A fastener assembly according to claim 1 wherein said fastener head portion defines a substantially frusto-conical surface.

3. A fastener assembly for use with large heat transfer rolls and adapted for joining a sheet of insulating material to a protruding bolt head or the like which defines an axis, said fastener assembly comprising: a molded plastic cup-like body defining a cavity for accepting said bolt head or the like and a quantity of high temperature adhesive material therewithin; means for retaining said body on said bolt head during setting of said adhesive material; a plurality of through apertures in said cup-like body for releasing any excess quantity of said adhesive material therefrom; a cylindrical shaft portion of plastic material integral with and projecting axially outwardly from said cup-like body and away from said bolt head and of sufficient axial extent to project through said sheet of insulating material; enlarged head portion carried on an axially outermost end of said shaft portion; said enlarged head portion converges axially outwardly and includes a base of diameter greater than the diameter of said cylindrical shaft portion and is coupled therewith to thereby define a substantially annular, radially extending shoulder portion at the junction thereof; and a clamping member of molded plastic material including a first surface defining therein a complementary fastener aperture for engaging said head portion and a second, abutment surface having an annular ring and extending radially outwardly of said first surface for overlying and abutting a portion of said sheet of material to thereby secure said sheet of material in juxtaposition to said protruding bolt head or the like; a first flexible web portion joining said fastener portion with said annular ring; said flexible web defining a first frusto-conical surface which diverges from said fastener portion to said annular ring in a generally radially outward and axially inward direction; said clamping member fastener portion further comprises a generally circular disc-like body having a through central cruciform opening resiliently deformable for receiving said fastener head therethrough and snappingly engaging with said annular shoulder portion defined between said fastener head and said shaft portion.

4. A fastener assembly according to claim 3 wherein said clamping member further includes a second flexible web portion intermediate and joining said disc-like body with said first flexible web portion and defining a second frusto-conical surface which converges axially inwardly from said first web to said disc-like body; said first and second flexible webs thereby providing a resiliency of said clamping body for positive engagement in generally axial tension with said sheet of material about the interengaged fastener head and fastener aperture.

5. A fastener assembly according to claim 4 wherein said first flexible web comprises a plurality of evenly spaced, radially outwardly extending and axially outwardly converging legs.

6. A fastener assembly according to claim 5 wherein said first flexible web further comprises an additional annular reinforcing portion joining said legs intermediate said disc-like body and said annular abutment portion.

* * * * *